United States Patent [19]

Junak

[11] 4,015,576

[45] Apr. 5, 1977

[54] IGNITION SYSTEM

[76] Inventor: Edward M. Junak, 1835 Bass, Grand Junction, Colo. 81501

[22] Filed: Apr. 22, 1974

[21] Appl. No.: 462,595

[52] U.S. Cl. ..... 123/148 E; 123/148 CB

[51] Int. Cl.[2] ..... F02P 1/00

[58] Field of Search ..... 123/148 E, 148 OC

[56] References Cited

UNITED STATES PATENTS

| | | | |
|---|---|---|---|
| 3,056,066 | 9/1962 | Dozier | 123/148 OC |
| 3,280,809 | 10/1966 | Issler | 123/148 OC |
| 3,407,795 | 10/1968 | Aiken et al. | 123/148 E |
| 3,550,573 | 12/1970 | Kowalski | 123/148 E |
| 3,575,154 | 4/1971 | Taylor | 123/148 E |
| 3,677,253 | 7/1972 | Oisai et al. | 123/148 OC |
| 3,832,986 | 9/1974 | Dogadico | 123/148 E |
| 3,837,326 | 9/1974 | Kamiji | 123/148 E |
| 3,866,590 | 2/1975 | Howard | 123/148 E |
| 3,874,354 | 4/1975 | Crouch | 123/148 E |
| 3,877,453 | 4/1975 | Brungsberg | 123/148 E |
| 3,897,767 | 8/1975 | Gordon et al. | 123/148 E |

*Primary Examiner*—C. J. Husar
*Assistant Examiner*—Paul Devinsky
*Attorney, Agent, or Firm*—Herzig & Walsh Inc.

[57] ABSTRACT

An ignition circuit arranged to deliver pulses of energy to an internal combustion engine includes inductive-type ignition circuitry and a pulse generator. Inductive ignition pulses are generated in time correspondence with engine movements in response to timing signals generated by breaker points and the pulse generator is simultaneously triggered to generate a high amplitude pulse which combines with the inductive ignition pulse to produce a composite ignition pulse having a fast-rise time and relatively long duration. Circuitry, biased by the pulse generator output, is associated with the breaker points which effectively isolates the breaker points electrically from voltage and current signals which tend to cause arcing thereacross. Thereby, deterioration of the breaker points caused by arcing is prevented. The circuit may be arranged so that the pulse generator or the inductive-type ignition circuitry may be selectively disabled.

5 Claims, 6 Drawing Figures

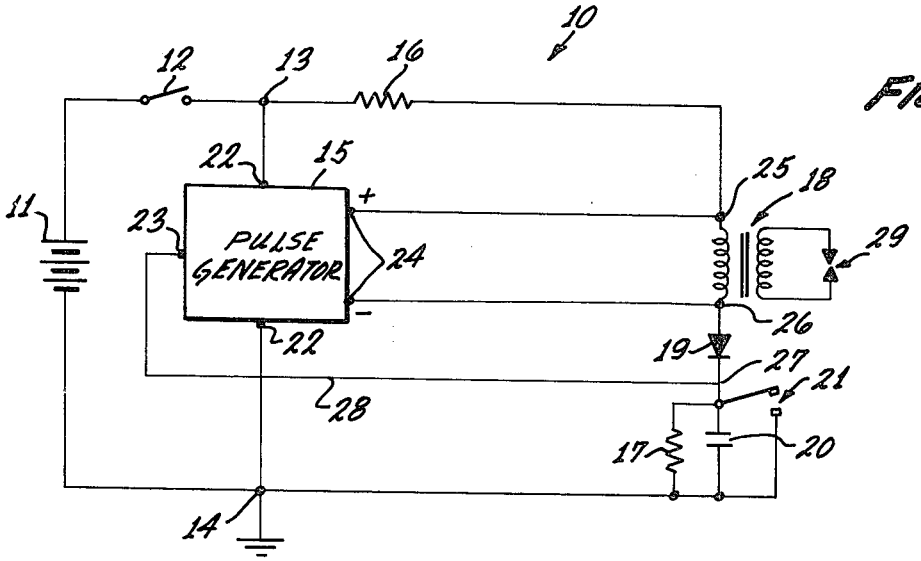
FIG. 1
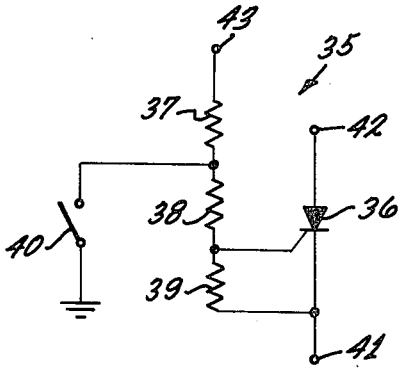
FIG. 2
FIG. 3
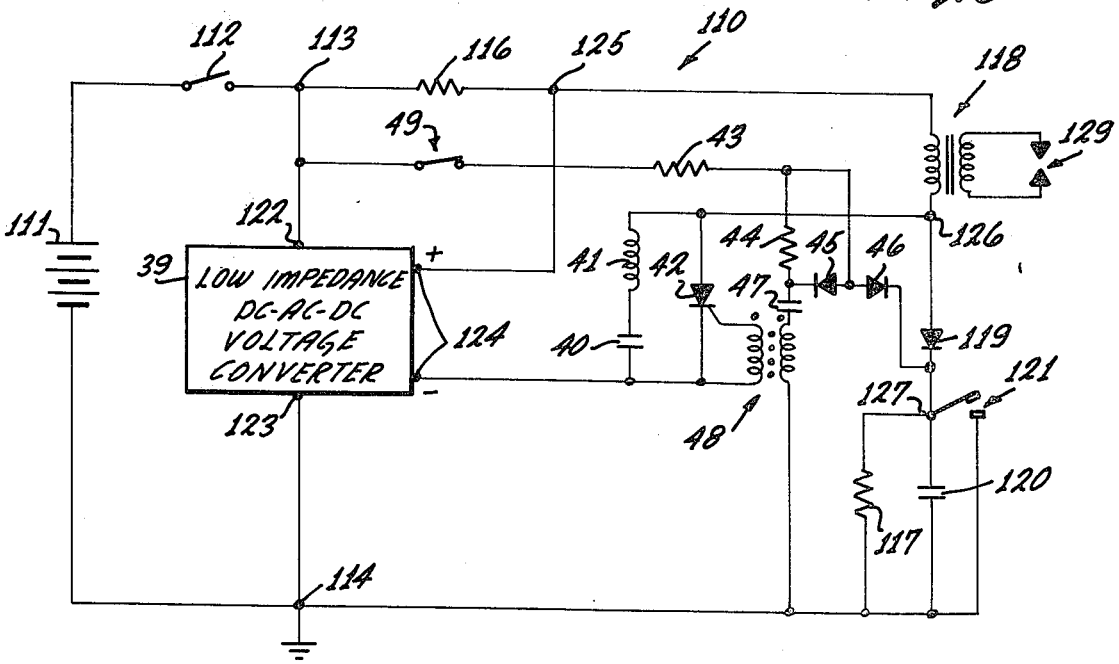

IGNITION SYSTEM

BACKGROUND OF THE INVENTION

The present invention relates to an improved inductive type ignition system for use with internal combustion engines and the like.

Heretofore, various types of ignition systems have been devised for internal combustion engines. Listed below are a number of U.S. Patents known to the inventor which describe various types of prior art ignition systems.

| PATENT NO. | INVENTOR | ISSUE DATE |
|---|---|---|
| 1,259,995 | Kettering, et al. | Mar. 19, 1918 |
| 3,056,066 | Dozier, Jr. | Sept. 25, 1962 |
| 3,280,809 | Issler | Oct. 25, 1966 |
| 3,550,573 | Kowalski | Dec. 29, 1970 |
| 3,677,253 | Oishi, et al. | July 18, 1972 |
| 3,704,397 | Crouch, et al. | Nov. 28, 1972 |

Generally, prior art ignition systems have been unreliable for one or more of the following reasons:

a. Incapable when engine spark plugs are contaminated of generating ignition sparks of sufficient energy to ignite a fuel-air mixture;

b. Incapable of keeping engine spark plugs clean from carbon deposits and other contaminants;

c. Characterized by generating an ignition spark of too short duration to completely ignite non-homogenous fuel-air mixtures;

d. Subject to arcing across breaker points employed as timing means, thus have been plagued by unreliability caused by deterioration of the breaker points;

e. Have had only one source of ignition pulses so as to become inoperative whenever this one energy source becomes inoperative.

f. Failure of breaker point timing means to switch currents caused by circuit operation at current levels insufficient to burn away contaminants.

SUMMARY OF THE INVENTION

It is an object of the present invention to provide an improved induction type of ignition system for use with internal combustion engines and the like which is characterized by obviating the aforementioned disadvantages of prior art ignition circuits.

It is also an object of the present invention to provide an improved versatile ignition system adaptable for use with solid state, mechanical or other timing means and which may be powered by battery, a magnetic current source, or any other suitable power source.

It is additionally an object of the present invention to provide an improved ignition system suitable for application in automobiles, aircraft, motorcycles and the like.

It is further an object of the present invention to provide an improved ignition system as set forth characterized by being: reliable; capable of generating a composite ignition pulse having a fast rise time and relatively long duration; having redundant ignition pulse generating circuitry so that failure or disabling of a portion of the pulse generating circuitry does not necessarily disable the entire ignition circuit; and being operable to protect breaker point timing means from voltage and current signals which tend to cause arcing thereacross.

In accomplishing these and other objects, there is provided in accordance with the present invention an ignition system arranged to deliver pulses of energy to an internal combustion engine. The exemplary ignition system includes inductive-type ignition circuitry and a pulse generator. Inductive ignition pulses are generated in time correspondence with engine movements in response to timing signals generated by breaker points and the pulse generator is simultaneously triggered to generate a high amplitude pulse which combines with the inductive ignition pulse. Thereby a composite ignition pulse having a fast rise time and relatively long duration is produced. Circuitry, biased by the pulse generator output, is associated with the breaker points which protects the breaker points from voltage and current signals tending to cause arcing thereacross. Thereby, deterioration of the breaker points caused by arcing is essentially prevented. The system may be arranged so that the pulse generator or the induction type ignition circuitry may be selectively disabled.

Additional objects of the present invention reside in the specific construction of the exemplary embodiments of ignition circuits hereinafter described in connection with the several drawings.

BRIEF DESCRIPTION OF THE DRAWINGS

FIG. 1 is a circuit diagram of an ignition system according to the present invention.

FIG. 2 is an alternate circuit arrangement which may be used in the ignition system of FIG. 1 to decouple the breaker points from the primary winding of the ignition coil.

FIG. 3 illustrates the circuitry of one suitable type of pulse generator connected in the ignition circuit of FIG. 1.

DETAILED DESCRIPTION OF THE PREFERRED EMBODIMENTS

Figure 4:
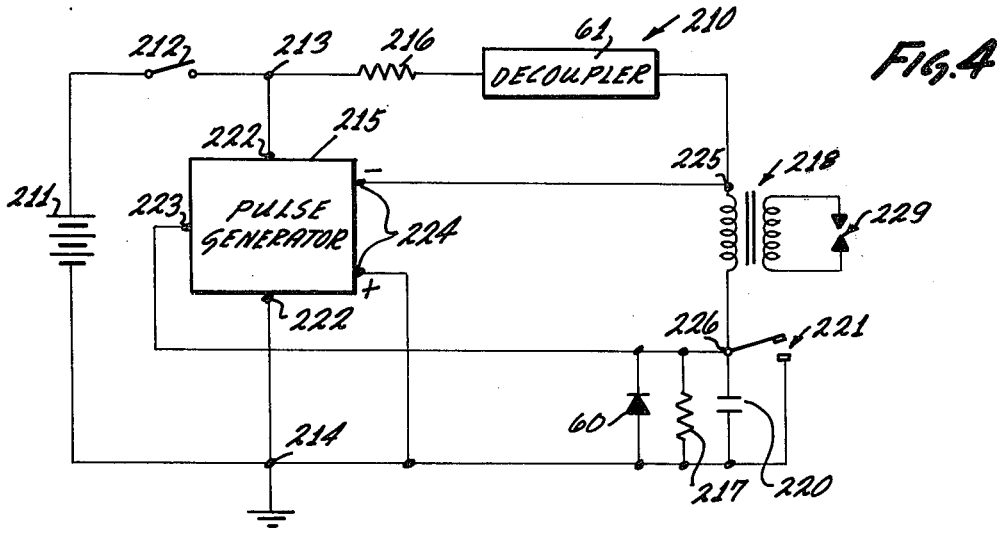
FIG. 4, 5 and 6 are each circuit diagrams of different embodiments of ignitions systems according to the present invention.

Referring to the drawings in more detail, there is shown in FIG. 1 an engine ignition system generally identified by the numeral 10. The ignition system 10 includes a D.C. voltage source in the form of a battery 11. The battery 11 may supply approximately 12 Volts D.C., as is common in vehicles of conveyance. Connected in series with the battery 11 to its positive pole is an ignition switch 12 for switching the ignition system on and off. Closure of ignition switch 12 supplies voltage to the circuit points 13 and 14. The circuit point 14 is connected in common with the negative pole of the battery 11 and is illustrated grounded.

The ignition circuit 10 includes a pulse generator 15; resistors 16 and 17; an ignition coil 18; a diode 19; a capacitor 20; and breaker points 21.

The pulse generator 15 has power input terminals 22, a trigger input terminal 23 and output terminals 24. The pulse generator 15 has its power input terminals 22 connected to the circuit points 13 and 14 to receive power from the battery 11 when the ignition switch 12 is closed.

Connected in the following order in series between the circuit points 13 and 14 are the resistor 16, the primary winding of the ignition coil 18, and the diode 19. The diode 19 is connected with its anode common with the primary winding of ignition coil 18 and its cathode common with the breaker points 21. Connected in parallel with breaker points 21 are the capacitor 20 and the resistor 17.

For purposes of discussion, the cirucit points 25, 26 and 27 are identified in the ignition circuit 10. The circuit point 25 is common with the point of connection between the resistor 16 and the primary winding of the ignition coil 18 and has the positive output terminal 24 of the pulse generator 15 connected thereto. The circuit point 26 is common with the point of connection between the primary winding of the ignition coil 18 and the anode of the diode 19. The negative output terminal 25 of the pulse generator 15 is connected to circuit point 26. Circuit point 27 is common with the connection between the cathode of the diode 19 and the breaker points 21. Electrical lead 28 connects the circuit point 27 in common with the trigger input terminal 23 of the pulse generator 15.

Connected across the secondary winding of the ignition coil 18 is a standard distributor and spark plugs represented by a single spark gap 29. Before describing the operation of the circuit 10, it is noted that the pulse generator 15 may be of any suitable type which is operable when triggered to generate a relatively short duration high amplitude output pulse across its output terminals 24. The output pulse may have a magnitude of 300 volts, may be in the form of a square wave, and has a duration which is shorter than the duration of the inductive ignition pulse generated by the induction ignition circuitry of the circuit 10, preferably only a small fraction of the duration thereof. For example, the pulse generator output pulse may have a duration of one hundred microseconds.

Upon closure of ignition switch 12, the ignition circuit 10 operates in the following described manner. The breaker points 21 function as timing means which control the generation of ignition pulses and are opened and closed in a conventional manner in time correspondence with the operation of the distributor and spark plugs represented by the gap 29. The distributor operates in a timed sequence to control the delivery of ignition pulses to the spark gaps 29 of the appropriate spark plugs in the conventional engine (not shown) being operated. Thereby, potentials developed on the ignition coil 18 are delivered or distributed in a timed sequence in a well known and conventional manner to the spark gaps 29 of the spark plugs associated with the cylinders or combustion chambers of the engine being operated. Thus, ignition sparks are generated to ignite the combustible fuel mixtures delivered to the engine cylinders.

With ignition switch 12 closed upon each closure of the breaker points 21, a current flows through the current path defined by the resistor 16, primary winding of the ignition coil 18, the diode 19 and the breaker points 21. This current flow is not sufficient to generate an ignition spark across the spark gap 29 and operates to store electromagnetic energy in the primary winding of the ignition coil 18. During this period of closure of the contacts 21, the circuit point 27 is grounded.

Upon opening of the breaker points 21, the ground is removed from the point 27 and the current flow therethrough is interrupted. Thus, the inductive energy stored in the primary winding of ignition coil 18 causes the capacitor 20 to charge. As a result, a trigger voltage is generated on circuit point 27 which is transmitted by lead 28 to the trigger input terminal 23 of the pulse generator 15. A high magnitude short duration pulse is consequently generated on the output terminals 24 of the pulse generator 15. This pulse is applied to the primary winding of ignition coil 18 and consequently a fast rise high amplitude ignition pulse is generated across the spark gap 29 due to the transformer action of the coil 18. Upon termination of the ouput pulse of the pulse generator 15, the operation of the induction ignition circuit provided by the resistor 16 and the ignition coil 18 takes over to generate a relatively long duration inductive ignition pulse across the spark gap 29. Thus, a composite ignition pulse is formed which has a fast rise time and long duration. It is noted that typically the pulse generator 15 is triggered into operation by a voltage signal less than 20 volts.

It is noted that when the pulse generator 15 is triggered into operation that a very high negative voltage such as −288 V appears on the circuit point 26 which reverse biases the diode 19. As a result, the diode 19 operates to decouple the breaker points 21 from the primary winding of ignition coil 18. Consequently, large voltage and current signals which would cause arcing, just after the points 21 have opened when their separation is relatively small, do not appear across the breaker points 21. It is further noted that the pulse generated by the pulse generator 15 in FIG. 1 is applied across the primary winding of ignition coil 18 in the same sense as the energy supplied by the battery 11 so that this pulse tends to increase the energy stored in the primary winding of the ignition coil 18. Upon termination of the pulse of the pulse generator 15, the current flow in the primary winding of the coil 18 reverses at which time diode 19 again becomes forward biased causing the charging of capacitor 20 to resume. It is noted that the mechanical gap of the breaker points 21 has increased during the time the diode 19 was reverse biased due to the mechanical driving arrangement operating the breaker points with the result that the points are sufficiently separated at the time the diode 19 again becomes forward biased to prevent any arcing subsequent to the termination of the pulse generator output pulse. The resistor 17 connected in parallel with the capacitor 20 functions to drain to ground any charge accumulated thereon during the generation of the trigger pulse and inductive pulse on circuit point 27.

It is noted that in the circuit of FIG. 1, as well as the other circuits hereinafter described, that the battery 11 and resistor 16 forming the battery power source could be replaced by a magnetic energy source such as a magneto. Also there is no requirement that these ignition systems be used with a conventional distributor. Some applications in which these ignition systems may be used do not include such a distributor, such as motorcycles, gas burner ignitors and jet engines.

FIG. 2 represents an alternate circuit arrangement for decoupling the breaker points 21 from the ignition coil 18 during the generation of ignition pulses. The decoupling circuit arrangement shown in FIG. 2 is generally identified by the numberal 35 and is formed by a silicon controlled rectifier (SCR) 36, a voltage divider made up of resistors 37–39 and an on-off switch 40. For purposes of discussion, the circuit points 41, 42 and 43 are designated in the decoupler circuit arrangement 35.

In order to use the decoupler circuit 35 in the ignition circuit 10, the diode 19 is first removed. The silicon control rectifier is then connected in series between the primary winding of ignition coil 18 and the breaker points 21 by commonly connecting circuit points 42, 26 and 41, 27. Voltage is supplied to the voltage divider defined by resistors 37–39 by commonly connecting circuit points 13 and 43. The on-off switch 40 which defines the disabling switch is connected between ground and a selective point on the voltage divider, illustrated as the point of interconnection of the resistors 37 and 38. With the decoupler circuit 35 connected in ignition circuit 10 instead of the diode 19, the ignition circuit 10 functions in the same manner as above described with the on-off switch 40 open, with the added advantage that the charging of capacitor 20 does not resume upon termination of the output pulse of the pulse generator 15 since the SCR 19 is turned off during this pulse and remains nonconductive during the generation of the inductive ignition pulse. By selectively closing the switch 40, the induction ignition circuitry of the ignition circuit 10 may be selectively disabled. Closure of the switch 40 grounds the point of interconnection between the resistors 37, 38 with the result that the SCR 36 does not conduct when the points 21 close. Consequently, inductive energy is not stored in the primary winding of ignition coil 18 during the time period which the points 21 are closed.

FIG. 3 illustrates an ignition system similar to that above-described and shown in connection with FIG. 1. The circuit shown in FIG. 3 is identified generally by the numeral 110, and its components which correspond to components above described in connection with FIG. 1 are identified by a 100 numeral having the same last two digits used in FIG. 1. One configuration of suitable pulse generator is shown in the ignition circuit 110 and this pulse generator includes a low impedance DC-AC-DC voltage converter 39; an L-C resonance circuit made up of capacitor 40 and inductor 41; trigger switch means in the form of an SCR 42; and trigger signal generating means made up of resistors 43–44, diodes 45–46, a capacitor 47 and a pulse transformer 48.

The ignition circuit 110 operates in a manner similar to that above-described in connection with FIG. 1. The pulse generator therein generates a fast rise short duration ignition pulse in the following manner. The voltage converter 39 may be of any conventional type, such as an oscillator or pulse type. The converter 40 converts the 12 volt DC signal received from battery 111 to a high voltage DC signal, such as a 300 volt signal, on its output terminals 124. Upon opening of the breaker points 121, the voltage on the cathode of the diode 46 increases to reverse bias this diode. As a result, current flows in the circuit path defined by the resistor 43, diode 45, capacitor 47 and the primary winding of the pulse transformer 48 to charge the capacitor 47. As a consequence, the current through the primary winding of the transformer 48 generates a trigger pulse in its secondary winding of this coil which triggers the SCR 42 into conduction. Triggering of the SCR switch 42 into conduction connects the output terminals of the converter 39 across the primary of the ignition coil 118 to apply the large voltage on these terminals thereacross. As a consequence, a fast rise ignition pulse in generated in the L-C circuit made up of capacitor 40 and inductor 41 is triggered into oscillation The duration of the ignition pulse generated by this pulse generator is equal to the time period the SCR 42 conducts which in turn is determined by the resonant frequency of the L-C circuit 40–41. The L-C circuit 41 functions solely as a timing means to control the period of conduction of the SCR 42 since after a half cycle of resonance the L-C circuit 40, 41 reverse biases the SCR 42 into a nonconductive state. Thus, the duration of the pulse generated by the pulse generator in this circuit may be controlled by appropriately selecting the values of capacitance and inductance of the components 40 and 41.

The pulse generator shown in FIG. 3 is a variation of a thyristor converter circuit. It is noted, however, that a blocking oscillator circuit or other type of high power ouput low impedance pulse generator circuit could be also employed.

When the breaker points 121 close, inductive energy is restored in the primary winding of the ignition coil 118. Simultaneously, the capacitor 47 is discharged through the current path defined by the resistor 44, diodes 46 and 119, and the breaker points 121. It is noted that the time delay associated with the discharge of the capacitor 47 and the increase in current flow through the primary winding of the ignition coil 118 ensures that arcing will not occur across the breaker points 121 due to momentary bounce of the breaker points at the time of their closure. It is noted that the pulse generator shown in FIG. 3 may be selectively disabled by opening the on-off switch 49.

FIG. 4 discloses an alternate embodiment of ignition circuit according to the present invention generally identified by the numeral 210. Components of the ignition circuit 210 corresponding to components in the ignition circuits hereinbefore described are identified by a two hundred number with its last two digits corresponding to the two digit number hereinbefore used to indentify the same component.

In operation of the ignition circuit 210, upon opening of the breaker points 221, the pulse generator 215 provides a fast rise short duration ignition pulse which is delivered to the primary winding of the ignition coil 218 through diode 60. It is noted that the pulse generated by the pulse generator 215 causes current to flow through the primary winding of the coil 218 in the same direction as the inductive ignition pulse induced therein. The diode 60 functions to prevent arcing across the breaker points 221 since it is forward biased by the pulse output of the pulse generator 215. Diode 60 becomes reverse biased during the generation of the inductive portion of the composite ignition pulse delivered to the spark gap 229. However, the increase of the mechanical gap of the breaker points prevents arcing theracross. It is noted that the trigger pulse delivered to trigger input terminal 223 is generated upon the opening of the breaker points 221 since at the instant the diode 60 is reverse biased, thus the capacitor 220 commences to charge. Further, it is noted that a decoupler 61 is shown connected between the resistor 216 and the primary winding of ignition coil 218. Decoupler 61 may be formed by a resistor or inductor of suitable value. The decoupler 61 operates to effectively decouple the ignition coil 218 from the battery 211 during the generation of ignition pulses. This action assures that the pulse generator circuit is not shunted by the battery and that sufficient current flows in the primary winding of the coil 218.

Figure 5:
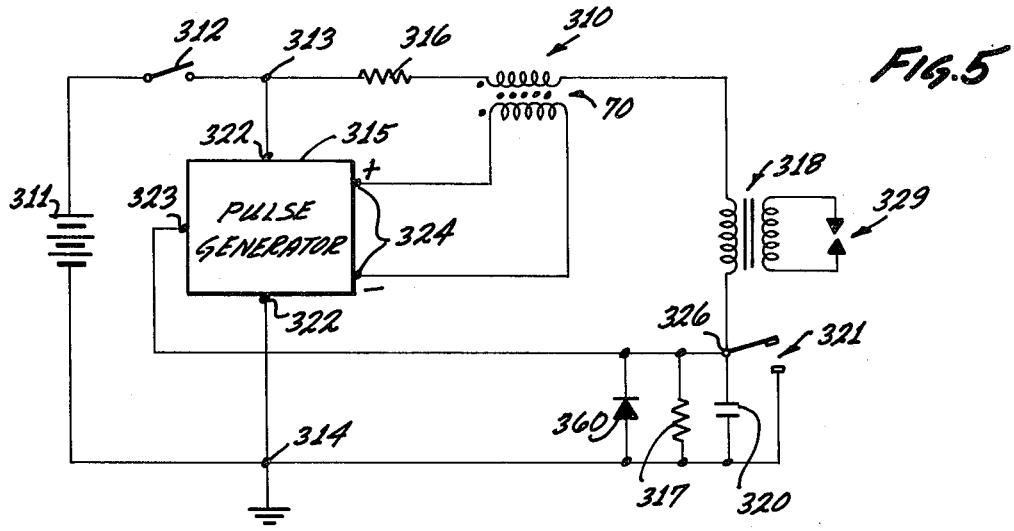

The ignition circuit 310 shown in FIG. 5 is numbered in a manner similar to that used for the ignition circuit 210 and uses numbers in the three hundred series. In the ignition circuit 310 the pulse generator 315 is inductively coupled to the primary winding of the ignition coil 318. This inductive coupling is illustrated being accomplished by connecting the secondary winding of pulse transformer 70 between the resistor 316 and the primary winding of the ignition coil 318. The primary winding of the transformer 70 is connected across the output terminals of the pulse generator 315. The transformer 70 should have a ferrite core or be otherwise constructed for high frequency signals in order to preserve the fast rise time of the pulse generated by the pulse generator 315.

Figure 6:
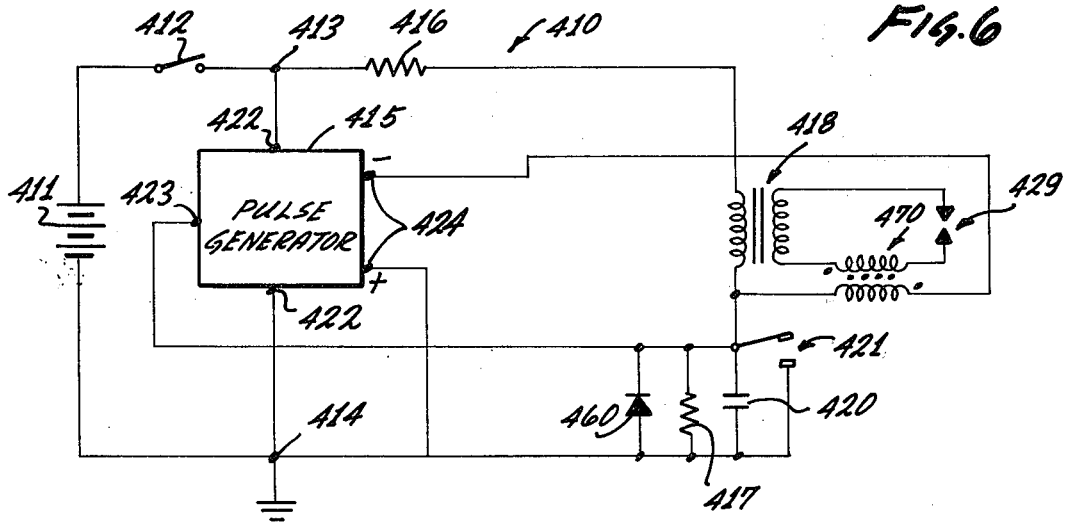

The embodiment of ignition system shown in FIG. 6 is generally indentified by the numeral 410 and has its components which correspond to components hereinabove described indentified by a four hundred numeral with the last two digits corresponding to the two digit number used hereinbefore to identify the same component. In the embodiment illustrated in FIG. 6, the pulse transformer 470 is illustrated with its secondary winding connected in series with the secondary winding of ignition coil 418. it is noted that the polarity of the output terminals of the pulse generator 415 are reversed from that shown in FIG. 5 and that the windings of the transformer 470 are connected with their polarities out of phase rather than in phase as shown in FIG. 5. In operation of the ignition circuit 410, the fast rise short duration pulse output of the pulse generator 415 is delivered through the secondary winding of the ignition coil 218 and the diode 460 in the circuitry functions as before described in connection with FIG. 4 to prevent arching at the breaker points 421.

Although I have herein shown and described my invention in what I have conceived to be the most practical and preferred embodiments, it is recognized that departures may be made therefrom within the scope of my invention.

I claim:

1. In an ignition system for generating energy pulses for firing spark plugs in combustion chambers of an engine thereby igniting a combustible fuel mixture within said combustion chambers comprising:

a. a source of electrical energy, b. an inductive means for generating inductive pulses for storing and releasing electromagnetic energy, and c. a contact breaking means for periodically making and breaking a circuit between said source of electrical energy and said inductive means whereby said inductive means receives energy from said source of electrical energy through said contact breaking means in one condition of said contact breaking means and releases said energy to said spark plugs in a second condition of said contact breaking means, the improvement comprising:

1. a pulse generating means for generating short pulses in addition to said inductive pulses, said pulses being of short duration and having fast rise time relative to said inductive pulses,

2. combining means for combining said short pulses and said inductive pulses, and

3. means for isolating said contact breaking means from said inductive means at least for the duration of said short duration pulse, whereby a pulse produced by an existing inductive ignition system is caused to have improved rise time and the contact breaking means are protected during a destructive portion of said pulse by the addition of the recited means, said combining means combining said short pulses having a first polarity and produced by said pulse generating means with said inductive pulses having a second polarity produced by said inductive means by coupling said pulse generator across said inductive means so that the inductive pulses and the short pulses are of opposite polarity, said isolating means being poled and connected between said inductive means and said contact breaker means for conduction responsive to said inductive pulses and for isolation responsive to said short pulses.

2. An ignition system defined in claim 1 wherein said timing means comprises:

a. a second capacitance, and b. an inductance coil connected to said second capacitance for turning off said controlled rectifier means.

3. In an ignition system for generating engery pulses for firing sparkplugs in combustion chambers of an engine thereby igniting a combustible fuel mixture within said combustion chambers comprising: a source of electrical energy, an inductive means for generating inductive pulses for storing and releasing electromagnetic energy, and a contact breaking means for periodically making and breaking a circuit between said source of electrical energy and said inductive means whereby said inductive means receives energy from said source of electrical energy through said contact breaking means in one condition of said contact breaking means and releases said energy to said spark plugs in a second condition of said contact breaking means, the improvement comprising:

a. a pulse generating means for generating short pulses in addition to said inductive pulses, said pulses being of short duration and having fast rise time relative to said inductive pulses, b. combining means for combining said short pulses having a first polarity and produced by said pulse generating means with said inductive pulses having a second polarity produced by said inductive means by coupling said pulse generator across said inductive means so that the inductive pulses and the short pulses are of opposite polarity, c. means for isolating said contact breaking means from said inductive means at least for the duration of said short duration pulse, said isolating means being poled and connected between said inductive means and said contact breaker means for conduction responsive to said inductive pulses and for isolation responsive to said short pulses, d. a high voltage dc to dc converter, e. a diode steering circuit responsive to said contact breaking means, f. a first capacitance g. said steering circuit causing current to charge said first capacitance and cause a voltage buildup thereon responsive to said second condition of said contact breaking means, h. a pulse transformer means responsive to said voltage buildup for providing a triggering pulse, i. a controlled rectifier means connected to said pulse transforming means responsive to said triggering pulse for providing a conductive path from said dc to dc high voltage converter to said inductive means and said isolating means, and j. a timing means connected across said conductive path formed by said controlled rectifier means for controlling the duration of conduction of said controlled rectifier means and the duration of said short pulse.

4. An ignition system defined in claim 3 wherein said poled isolation means comprises a diode.

5. An ignition system defined in claim 3 wherein said poled isolation means comprises a controlled — conduction device, whereby said contact breaking means are isolated from said inductive means for the duration of said short pulse and of said inductive pulse.

* * * * *